United States Patent [19]

Beyl

[11] 4,103,929

[45] Aug. 1, 1978

[54] SKI BINDING

[76] Inventor: Jean Joseph Alfred Beyl, 10 Boulevard Victor-Hugo, Nevers, Nièvre, France

[21] Appl. No.: 710,897

[22] Filed: Aug. 2, 1976

[30] Foreign Application Priority Data

Aug. 5, 1975 [FR] France ..... 75 24342

[51] Int. Cl.[2] ..... A63C 11/00

[52] U.S. Cl. ..... 280/611

[58] Field of Search ..... 280/611, 629, 630, 615, 280/625, 636

[56] References Cited

U.S. PATENT DOCUMENTS

| | | | |
|---|---|---|---|
| 3,508,761 | 4/1970 | Hoss | 280/625 |
| 3,595,595 | 7/1971 | Axthammer | 280/629 |

*Primary Examiner*—Joseph F. Peters, Jr.
*Assistant Examiner*—Gene A. Church
*Attorney, Agent, or Firm*—Bierman & Bierman

[57] ABSTRACT

A ski binding has a cheek for engagement with the sole, or sole and upper, of a ski boot, and elongated ribs are mounted on the cheek by a bridging portion of less width remote from the ski boot, a resilient slip lining being engaged by deformation on the ribs and having opposed longitudinal edges positioned adjacent the bridging portion, the slip linings being of polytetrafluoroethylene or other material with a low coefficient of friction.

5 Claims, 5 Drawing Figures

SKI BINDING

The present invention relates to ski bindings, such as front stops or heel-pieces, which comprise a mechanism making it possible to loosen them to release the corresponding boot when the skier's foot or leg is subjected to too great strain.

Bindings of this kind include an end-piece, a cheek or other bearing surface, designed to take the corresponding end of the sole or the upper of the ski boot in order to hold the latter in position. However, on loosening, a relative movement generally occurs between this bearing surface and the corresponding end of the boot and consequently, the latter slips on this surface. Moreover, for the release of the boot to take place in optimum conditions, the frictional forces should be as low as possible.

For this purpose, it has already been proposed to provide bindings of this kind with linings made of a material which has a very low coefficient of friction, in the case in point polytetrafluorethylene. However, in present bindings thus provided with such linings, these take the form of cut-out plaquettes fixed by means of an adhesive. Now, this solution comprises certain disadvantages.

First of all, plaquettes of this kind have a constant thickness and do not make it possible to achieve the complicated shapes which would be necessary to obtain good results. In fact, the surfaces facing the boot can only be flat, which is a disadvantage with certain types of boot. Moreover, to obtain contact on two planes, it is essential to provide for two separate slip plaquettes.

In addition, fixing such plaquettes involves certain difficulties. In fact, the surface of these plaquettes designed to take a layer of adhesive material must first undergo suitable chemical treatment. As far as the corresponding parts of the binding are concerned, these have to be carefully de-greased and, when the fixing is done, the slip plaquettes must be properly pressed to avoid air bubbles being interposed. Nevertheless, despite these precautions, the adhesive material loses its efficiency in time, so that the slip plaquettes can be torn away in use. Moreover, to avoid the risk of tearing away, it is in any case necessary to provide for the slip plaquettes to project very little in relation to their housing, which may limit the efficiency of such plaquettes.

Finally, it must be noted that replacing worn slip plaquettes is a difficult operation, not only for private individuals but also for sports equipment dealers, because of the various operations necessary to fix new slip plaquettes in position.

This is why the subject-matter of the present invention is a ski binding designed to comprise slip linings which do not have the disadvantages recalled above.

For this purpose, this binding is essentially characterised in that the bearing surface(s) designed to take the corresponding end of the ski boot comprise a rib, bead or other projecting member with a construction on the opposite side to the ski boot and on which is fixed, by flexible engagement, a slip lining made of polytetrafluorethylene or any other material which has a very low coefficient of friction, this lining consisting of a part of suitable shape to fit the shape of this projecting member, so that its edges engage in the channels or grooves which there are at the point where there is the constriction in the latter.

In these circumstances, fixing such slip linings in position is very easy to do without any special precautions. Moreover, it is possible to give these linings special shapes, depending on the shape of the corresponding parts of the ski boots.

However, the various features and advantages of the present ski binding will emerge from the following description of a few examples of embodiment of a front stop designed in this way. This description is given with reference to the drawing appended as an indication only and whereon:

Figure 1:
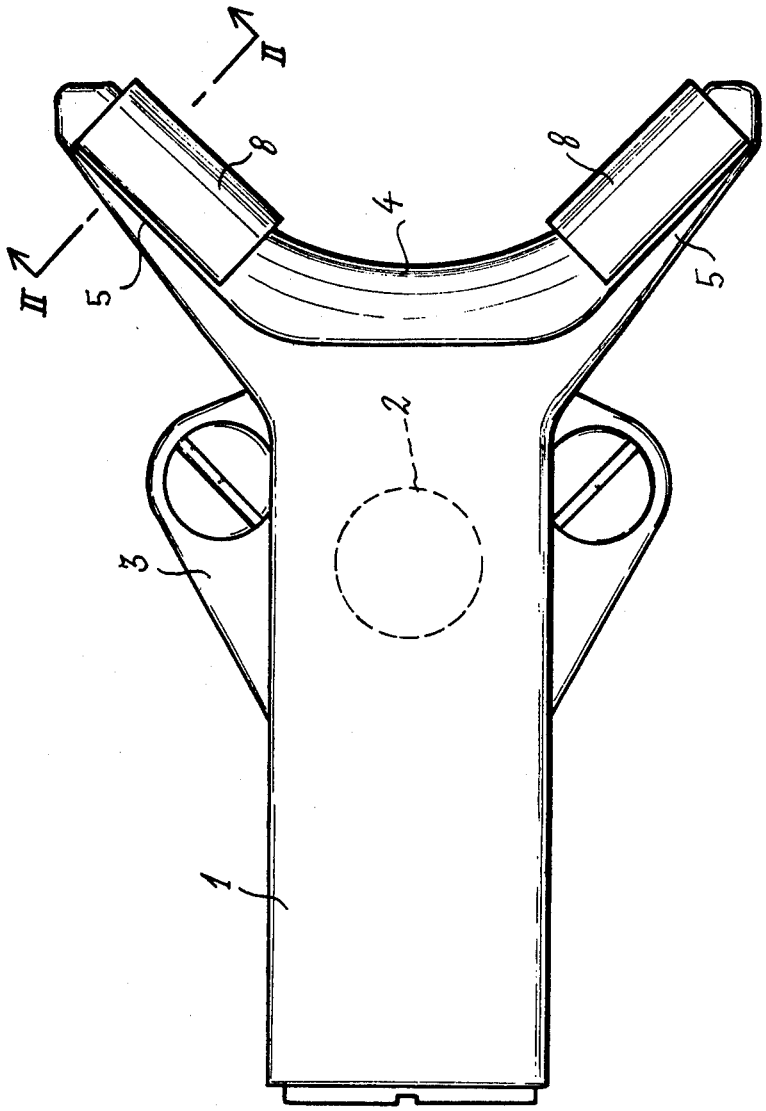
FIG. 1 is a plan view from above of this stop.
Figure 2:
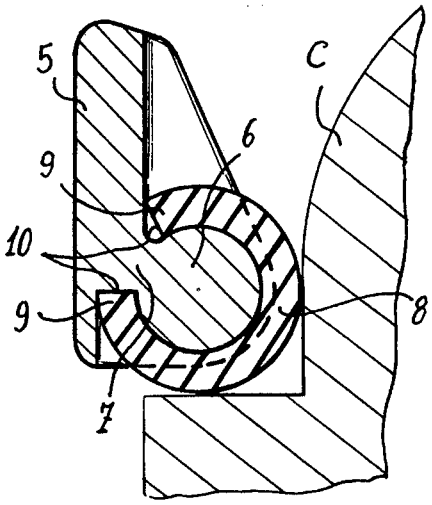
FIG. 2 is a part sectional view along the line II—II in FIG. 1.

As indicated above, FIGS. 1 and 2 show a ski binding from stop made in accordance with the invention. This stop comprises a main part 1 mounted rotatingly around a pivot 2 carried by a plate 3 designed to be fixed to the top of the ski forward of the place provided for the corresponding boot C.

At its rear end, the main part 1 of this stop has a cheek 4 designed to take the forward end of this boot, this cheek including two braches 5 arranged in a V so as partly to encircle the rounded end of the upper of the boot C.

In accordance with the present invention, each of the branches 5 of this cheek comprises a projecting rib 6 on the side facing the boot C and this rib is fastened on to the corresponding branch by a constricted area 7. Moreover, a slip lining 8 is inserted on the rib 6 of each of the branches of cheek 4. The lining consists of a piece of polytetrafluorethylene section manufactured by extrusion.

The shape of this section very precisely fits that of each of the ribs 6. In the case in point, in the example shown in FIGS. 1 and 2, this section is in the shape of a cylinder comprising a longitudinal slot the width of the constricted area 7 by which each rib 6 is fastened to the corresponding branch 5 of cheek 4. Thus, when the linings 8 are in position, their edges 9 are engaged inside the channels 10 which there are at the point where there is the constricted area 7. Consequently, the linings 8 are perfectly fixed in position. They are fixed by flexible engagement by momentarily separating the edges 9. This operation is therefore extremely easy to carry out and requires no spacial preparation or precautions. Moreover, this operation can be carried out by anybody. This therefore makes it possible easily to replace slip linings which may be worn out.

Another important advantage lies in the fact that the slip linings 8 are perfectly fixed in position and there is no risk of their being torn away in use, which is not the case with the slip plaquettes provided up to now in ski bindings.

However, yet another advantage consists of the fact that it is possible to make the slip linings in special shapes, depending on the shape of the corresponding parts of the ski boots. Indeed, FIGS. 3, 4 and 5 illustrate several different variants of embodiment.

Figure 3:
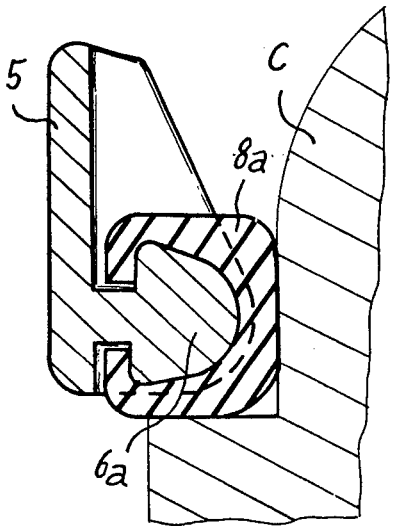
FIGS. 3, 4 and 5 are similar views to FIG. 2, but illustrating different variants of embodiment.
Figure 4:
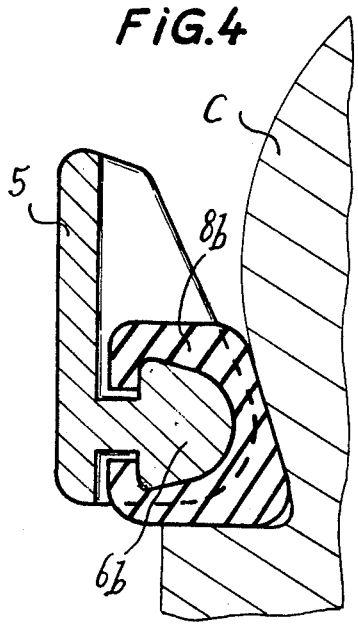

The variants in FIGS. 3 and 4 differ from the form of embodiment in FIG. 2 solely by the shape of the corresponding slip linings 8*a*, 8*b*, as well as by the shape of the projecting ribs 6*a*, 6*b* on which these linings are fitted. However, the method of mounting the latter is exactly the same as before.

Figure 5:
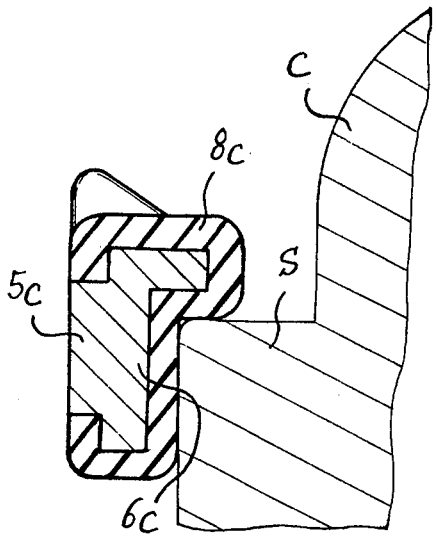

FIG. 5 shows a variant of embodiment wherein branches 5c of the cheek of the corresponding stop are designed to cooperate with the sole S of the boot C and not with the upper of the latter, as was the case before. In these circumstances, the shape of the corresponding slip lining 8c is consequently modified and the same applies to the shape of the projecting member 6c acting as a support for this lining.

But of course, the attached drawings merely illustrate a few possible variants of embodiment. Many other forms of construction are possible.

In this connection, it should be noted that the polytetrafluorethylene slip lining can be produced by moulding instead of being made from a section manufactured by extrusion. Moreover, these linings could be made of a material other than polytetrafluorethylene, providing that this material has a very low coefficient of friction.

Moreover, it should be recalled that the binding in accordance with the invention may constitute not only a front stop as in the case in the forms and variants of embodiment previously described, but also a rear heel-piece designed to hold the rear end of a ski boot. In fact, it is also necessary to facilitate the slip of the boot against such a heel-piece and for this purpose the latter can be fitted with slip linings such as linings 8a . . . 8c in the foregoing forms of embodiment, these being fixed by flexible engagement on projecting ribs provided on the bearing surface of the corresponding heel-piece.

What is claimed is:

1. In a ski binding for engagement with a ski boot of the kind including structure for mounting on a ski, said structure including a generally arcuate cheek for engagement selectively with the opposite sides of the sole and upper of the ski boot, the improvement which comprises:

(i) a pair of horizontally spaced, transverse ribs each extending across respective outer portions of said cheek, projecting in a direction to overlie at least partially the sole of the ski boot, bridging sections of less thickness than said ribs connecting each of said ribs to said cheek, and (ii) a pair of resiliently deformable slip lining means shaped to respectively fit about each rib and engaging the same by resilient deformation, each of said slip lining means having opposed internal transverse edges grasping opposite sides of the respective bridging sections and at least externally being formed of material selected to have a low coefficient of friction.

2. In a ski binding as claimed in claim 1, in which the projecting portion of each of said ribs is of circular cross section and defines with the cheek, in the region of the bridging section, respective channels in which the longitudinal edges of each of the slip lining means are positioned.

3. In a ski binding as claimed in claim 1, in which the projecting portion of each of said ribs is of mushroom-shaped cross section and defines with the cheek, in the region of the bridging section, respective channels in which the longitudinal edges of each of the slip lining means are positioned.

4. In a ski binding as claimed in claim 1, in which each of the ribs has an inverted L-shaped section.

5. In a ski binding as claimed in claim 1, in which each of the slip lining means is made of polytetrafluoroethylene.

* * * * *